US005440953A

United States Patent [19]

Gangelhoff et al.

[11] Patent Number: 5,440,953

[45] Date of Patent: Aug. 15, 1995

[54] KNIFE SHARPENER

[75] Inventors: Fred R. Gangelhoff; James H. Gangelhoff; Joel T. Gangelhoff, all of Ocala, Fla.

[73] Assignee: Tru Hone Corporation, Ocala, Fla.

[21] Appl. No.: 309,460

[22] Filed: Sep. 22, 1994

[51] Int. Cl.[6] ..... B24B 3/54

[52] U.S. Cl. ..... 76/86; 76/88; 451/486; 451/555

[58] Field of Search ..... 76/82, 84, 85, 86, 88, 76/DIG. 9; 451/45, 464, 468, 485, 486, 552, 555; 403/11, 23, 28

[56] References Cited

U.S. PATENT DOCUMENTS

| | | | |
|---|---|---|---|
| 772,542 | 10/1904 | Sullivan . | |
| 1,041,631 | 10/1912 | Johnson | 451/486 |
| 1,365,161 | 1/1921 | Eisenhauer . | |
| 1,429,984 | 9/1922 | Vollmer | 76/86 |
| 2,124,646 | 7/1938 | Barsch | 451/486 |
| 3,064,393 | 11/1962 | Chasan . | |
| 3,678,174 | 7/1972 | Ganzhorn | 403/23 |
| 4,550,632 | 11/1985 | Inman . | |
| 4,624,079 | 11/1986 | Bonapace . | |
| 4,799,576 | 1/1989 | Walker et al. | 403/23 |
| 4,934,110 | 6/1990 | Juranitch | 451/555 |
| 5,040,435 | 8/1991 | Millman | 76/86 |

*Primary Examiner*—Hwei Siu Payer

*Attorney, Agent, or Firm*—Jacobson, Price, Holman & Stern

[57] ABSTRACT

A knife sharpening device includes a vertically-oriented base having a vertically-oriented slot. Mounted on the base, on one side of the slot are two crossed sharpening members of a rod-like configuration. A lower end of each of the crossed sharpening members is anchored in a horizontally-extending pivot pin with a terminal end of each of the sharpening members extending beyond the pivot pins and engaging a horizontally-extending stop pin. The pivot pins are rotatably mounted in the base and extend through the base. A pivot wheel is mounted concentrically on a free end of the pivot pins on an opposite side of the base from the sharpening members. Two radially-extending set screws extend through the pivot wheels and engage a flat surface of the pivot pin to hold the pivot wheels on the pivot pins. Extending between the two set screws, threadingly mounted in the two pivot wheels, is a tensioning spring. The two ends of the spring are wrapped around the set screws and encased in a heat-shrunk polyolefin wrapper to secure the ends of the tension spring to the set screws.

16 Claims, 2 Drawing Sheets

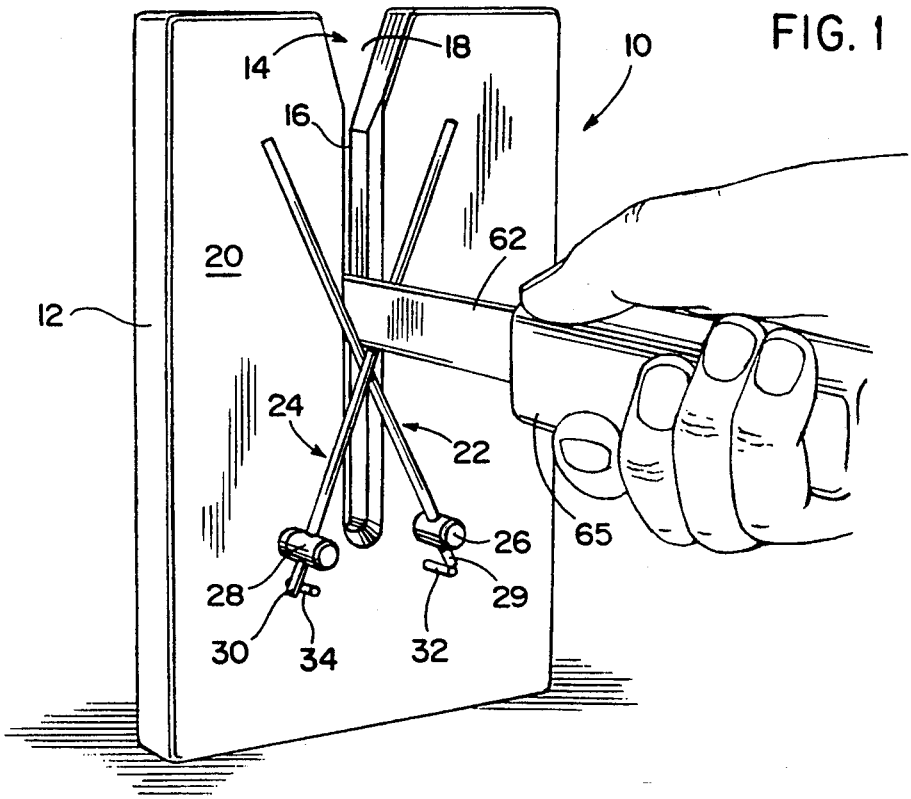
FIG. 1
FIG. 2
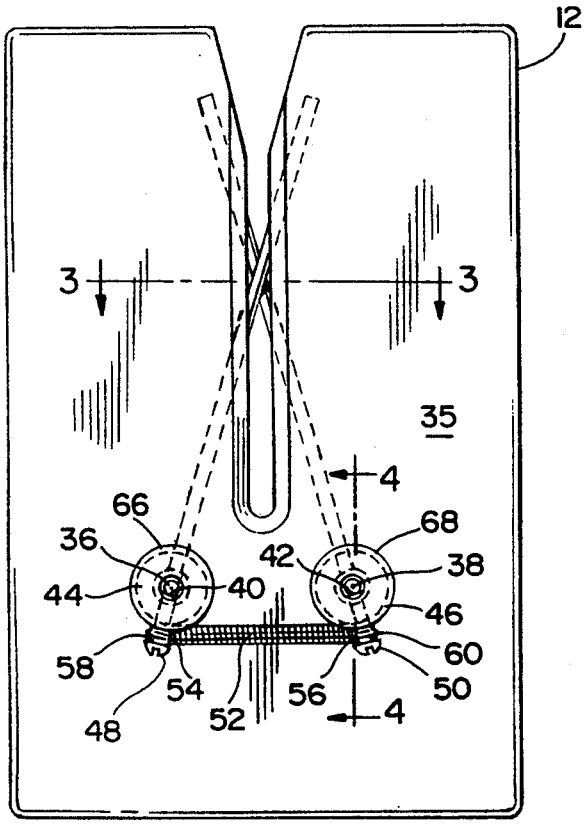
FIG. 3
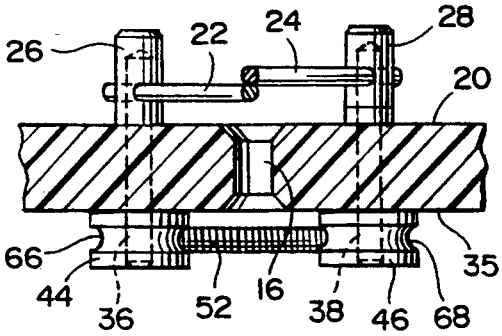
FIG. 4
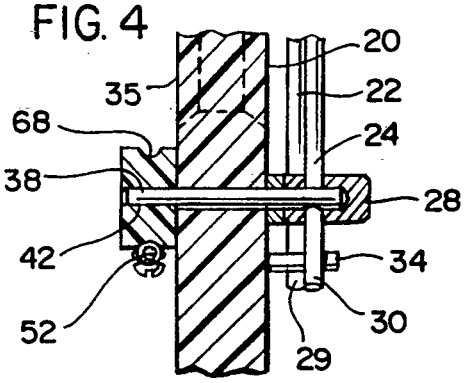

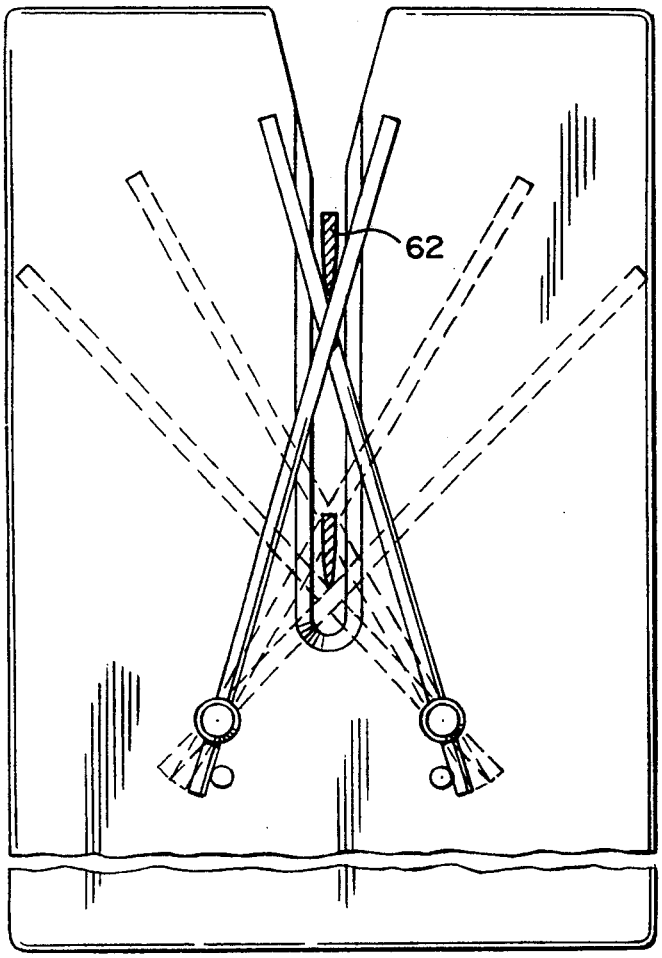
FIG. 5
FIG. 6
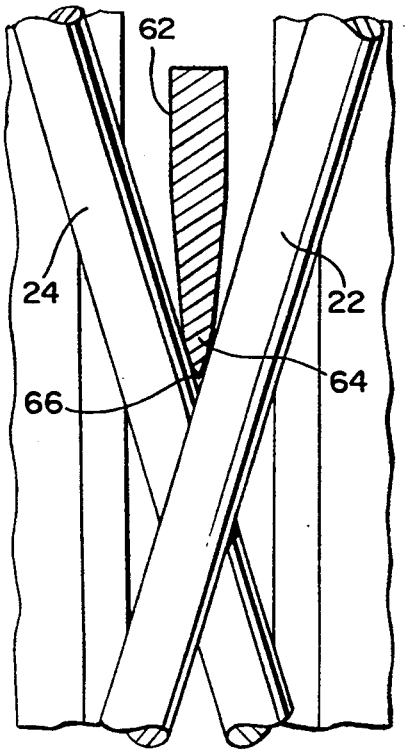
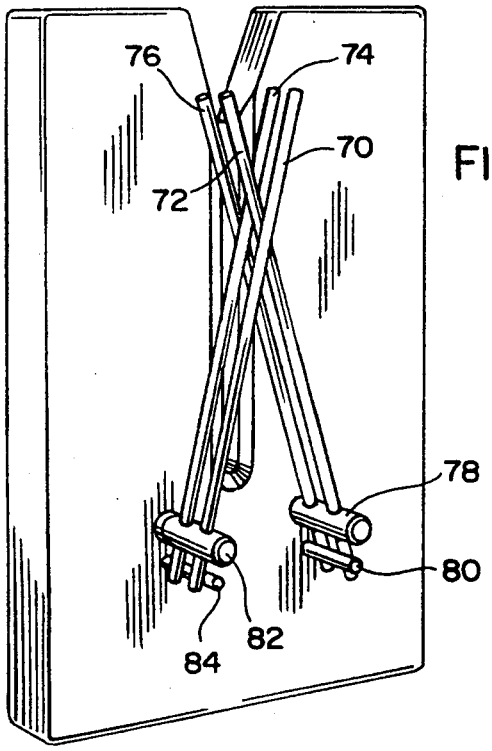
FIG. 7
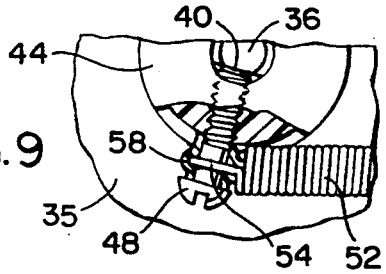
FIG. 9
FIG. 8
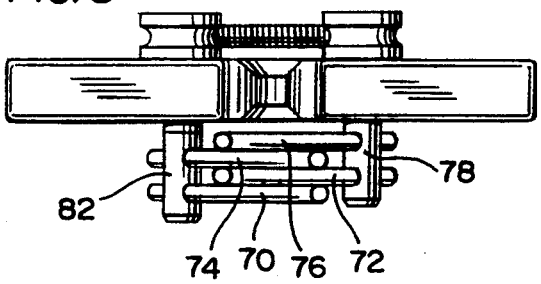

KNIFE SHARPENER

FIELD OF THE INVENTION

The present invention relates to a sharpener for a blade of a knife where a cutting edge of the blade is passed across two sharpening members ("steels") which are overlapped to form a V-shape.

BACKGROUND OF THE INVENTION

Individuals in the fish, meat, and poultry industries, as well as in institutional food businesses, who use knives on a continuous basis, require that the knives have a sharp cutting edge at all times. The cutting edge of the blade of a knife is generally sharpened by these individuals on a frequent basis at their position of work.

Prior art knife sharpening devices include the device disclosed in U.S. Pat. No. 772,542 to Sullivan where crossed sharpening elements are pivoted at a common pivot point and curved ends of the sharpening elements are biased together by a single tension spring. In U.S. Pat. No. 3,064,393 to Chasan, two sharpening elements are pivoted at one end and a spring biases the opposite ends towards each other. In U.S. Pat. No. 4,550,632 to Inman, a holder with a slot opening to the top of the holder has crossed sharpening elements pivoted at their upper ends and spring biased at their lower ends by individual springs. In U.S. Pat. No. 4,624,079 to Bonapace, two sharpening elements are crossed at their upper ends and spring biased at their lower ends by individual springs. Finally, U.S. Pat. No. 4,934,110 to Juranitch discloses various arrangements of crossed sharpening elements which are pivoted and spring biased at the same ends.

SUMMARY OF THE INVENTION

By the present invention, a knife sharpening device includes a vertically-oriented base having a vertically-oriented slot. Mounted on the base, on one side of the slot are two crossed sharpening members of a rod-like configuration. A lower end of each of the crossed sharpening members is anchored in a horizontally-extending pivot pin with a terminal end of each of the sharpening members extending beyond the pivot pins and engaging a horizontally-extending stop pin.

The pivot pins are rotatably mounted in the base and extend through the base. A pivot wheel is mounted concentrically on a free end of the pivot pins on the side of the base opposite from the sharpening members. Two radially-extending set screws extend through the pivot wheels and engage a flat surface of the pivot pin to hold the pivot wheels on the pivot pins.

Extending between the two set screws threadingly mounted in the two pivot wheels is a tensioning spring. The two ends of the spring are wrapped around the set screws and encased in a heat-shrunk polyolefin wrapper to secure the ends of the tension spring to the set screws. The wrapper also prevents the two set screws from unscrewing from the pivot wheels. In addition, in the event that the spring should break, the ends of the spring will remain secured to the set screws so as to avoid the potential harmful effects of springbreak product contamination which occurs when pieces of a spring are mixed in with the operator's work product, generally food.

Each of the pivot wheels includes an annular arcuate groove in the radially outermost surface of the wheel. Upon rotation of the pivot wheels, the spring anchored to the pivot wheels by the set screws is caused to move from a tangential position with respect to the pivot wheel to stretch about the pivot wheels, with the spring being located in the annular arcuate groove. The tension in the spring is thereby caused to be increased by the greater amount of movement of the spring as compared to a straight stretching of the spring. This increased tension is forced against the cutting edge of the blade during sharpening of the knife.

The spring anchored to the pivot wheels which surround the pivot pins places a bias on the sharpening members as the sharpening members are moved apart by a knife moved downwardly into the slot in the base and into the V-shape formed by the free ends of the sharpening members. Upon removal of the blade from between the sharpening members, the sharpening members spring back until the ends of the sharpening members contact the stop pins. The sharpening members are then in their position of rest.

During a sharpening operation, the angle of intersection between the free ends of the crossed sharpening members increases as a knife blade moves downwardly. The initial contact of the knife blade with the "V" of the sharpening members is made on the bevel of the blade, behind the edge, thereby protecting the delicate blade edge. As the knife blade moves downwardly, the edge of the blade gradually comes into contact with a V-shape formed between the two sharpening members. The knife may be pulled outwardly from the base during downward movement across the sharpening members or alternatively, the blade may be moved into the slot in the base during downward movement of the blade across the sharpening members. The actual sharpening technique is usually determined according to the "feel" by the operator to maximize the sharpening of the blade edge.

Accordingly, it is an object of the present invention to provide a knife sharpening device having a pair of crossed sharpening members pivotally mounted on a base with a stop pin for engaging a terminal end of the two sharpening members against a bias force exerted by a spring on the sharpening members.

It is another object of the present invention to provide a knife sharpening device having at least two crossed sharpening members having free ends forming a V-shape which are moved against a bias force according to a contour and position of a knife blade edge passing between the sharpening members in a downward direction.

It is yet another object of the present invention to provide a knife sharpening device having crossed sharpening members with their free ends forming a V-shape configuration and the sharpening members being biased to adjust to the contour of a knife blade being sharpened with the bias of the sharpening elements provided by a spring extending between anchored ends of the sharpening elements with a protective sleeve surrounding the ends of the spring so as to secure the ends of the springs to avoid springbreak product contamination.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 1 is a perspective view of a preferred knife sharpening device in accordance with the basic improvements of the present invention.

FIG. 2 is a rear view of the knife sharpening device of FIG. 1.

FIG. 3 is a cross-sectional view taken along line 3—3 of FIG. 2.

FIG. 4 is a longitudinal sectional view taken along line 4—4 of FIG. 2.

FIG. 5 is a front elevational view of the knife sharpening device of FIG. 1 with the crossed sharpening members illustrated in various positions.

FIG. 6 is an enlarged detail view of a knife blade initially contacting the crossed sharpening members of the FIG. 1 device.

FIG. 7 is a perspective view of a preferred knife sharpening device embodying the improvements of the present invention having two sets of the crossed sharpening members.

FIG. 8 is a top plan view of the FIG. 7 device.

FIG. 9 is an enlarged, partial sectional view of a set screw securing one end of a tension spring to a pivot wheel and securing the pivot wheel to a pivot pin while the one end of the tension spring is encased in a heat shrunk wrapper in accordance with the present invention.

DETAILED DESCRIPTION OF THE PREFERRED EMBODIMENTS

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1–4, in particular, a knife sharpener embodying the teachings of the subject invention is generally designated as 10. With reference to its orientation in FIG. 1, the knife sharpener includes a rectangular base 12 having a width of approximately 5⅝", a height of approximately 8¼", and a depth of approximately ¾". The base is made of a food industry-acceptable material so that it may be easily cleaned and used close to food processing. The base includes a vertically-extending slot 14 having an elongated portion 16 of approximately ⅜" width which leads to a triangular shaped portion 18 tapering outwardly from the elongated portion 16 to a width of approximately 1". While the foregoing dimensions are preferred, other sizes can easily be used consistent with the structure and purpose of the present invention.

Located on front surface 20 of the base are two sharpening members 22, 24 having a rod shape. A lower end of each sharpening member 22, 24 is secured within a rotatable pivot pin 26, 28. A lowermost end 29, 30 of sharpening members 22, 24 engages stop pins 32, 34, respectively, when the sharpening members 22, 24 are in a position of rest.

On a rear surface 35 of base 12, a reduced diameter portion 36, 38 of the pivot pins 26, 28, respectively, passes through the base 12. The reduced diameter portions 36, 38 extending from the rear surface 35 of the base include a flat surface 40, 42 extending to the terminal end of the portions 36, 38.

Mounted on the portions 36, 38 on the rear surface 35 of the base are pivot wheels 44, 46 having central openings through which the portions 36, 38 pass, respectively. Each pivot wheel includes a set screw 48, 50 which threadingly engages with the pivot wheels 44, 46, respectively. In a position of rest, a longitudinal axis of the set screws 48, 50 lies parallel to a longitudinal axis of the sharpening members 22, 24, respectively. The set screws 48, 50 extend radially towards a center of the pivot wheels and engage the flat surface 40, 42 of the reduced diameter portions 36, 38 of the pivot pins 26, 28 to secure the pivot wheels around the pivot pins with concentric axes.

A tension spring 52 extends between the set screws 48, 50 with opposite ends 54, 56 of the spring 52 being secured around the set screws 48, 50, respectively. Surrounding the set screws and each end of the spring 52 is a heat shrunk polyolefin wrapper 58, 60, as shown in detail in FIG. 9, for securing the ends of the tension spring to the set screws to prevent the set screws from rotating out of the pivot wheels. In the event that spring 52 should break, the ends 54, 56 of the spring will be retained on the set screw to prevent springbreak contamination.

The wrappers 58, 60 are positioned around the set screws 48, 50 and over the ends 54, 56 of the spring 52 as shown in FIG. 9 by sliding the wrappers 58, 60 over the ends 54, 56 of the spring and one adjacent spring spiral. The set screws 48, 50 are then passed through the ends 54, 56 of spring 52 and screwed into the pivot wheels 44, 46. Heat applied to the wrapper causes the wrappers 58, 60 to shrink and secure the set screws and spring ends in place.

During stretching of the spring 52 due to the engagement of the sharpening members 22, 24 by a blade 62 secured to a handle 65 of a knife, the outer ends of the spring 52 are caused to be pulled into arcuate grooves 66, 68 formed in a periphery of the pivot wheels. The stretching of the spring 52 from a tangential point of contact with the pivot wheels to a position wrapped around the pivot wheels within a groove of the pivot wheels, causes increased tension on the spring. The increased tension on the spring is transmitted to the sharpening members through the pivot pins 26, 28, thus increasing the resistance against pivoting movement of the sharpening members.

As shown in FIG. 5, and in more detail in FIG. 6, a downwardly moving knife blade 62 initially contacts a generally narrow V-shape formed between the ends of the sharpening members 22, 24 when the sharpening members 22, 24 are in a position of rest. Thus, a bevel 64 of the blade 62 initially contacts the sharpening members 22, 24 with cutting edge 66 of the blade 62 being spaced from contacting the sharpening members 22, 24. Then as shown in phantom lines in FIG. 5, as the knife blade 62 is moved downwardly in contact with the sharpening members 22, 24, the angle of inclination between the sharpening members 22 and 24 increases so that the cutting edge 66 of the blade 62 gradually comes into contact with the sharpening members as the angle of intersection of the sharpening members becomes wider. This ensures a gradual contact of the cutting edge with the sharpening members for movement of the blade across the sharpening members and thereby sharpening the cutting edge.

The two sharpening members are preferably made of steel and can be roughened to have any desired degree of abrasiveness to grind or abrade the blade edge. Preferably, the sharpening members have the same degree of abrasiveness but opposite pitch if the roughened surface has a pitch. Alternatively, the two sharpening members may have a smooth steel surface to burnish the blade edge.

In an alternative embodiment as shown in FIGS. 7 and 8, two sets of sharpening members are mounted on the pivot pins in the base. In FIG. 7, crossed sharpening members 70 and 72 are located in front of crossed sharpening members 74 and 76. Sharpening members 70 and 74 are anchored in pivot pin 82 and engage stop pin 84. Similarly, sharpening members 72 and 76 are anchored in pivot pin 78 and engage stop pin 80. With two pairs of sharpening members, two different levels of abrasiveness can be imparted to the cutting edge. A single stroke of the knife will produce a degree of sharpening previously achieved only by using two separate sharpening devices of different abrasiveness. For example, the two front elements can burnish the blade edge and two rear elements can grind or abrade the blade edge. Also, the four elements can be used simultaneously or in single pairs by angling the knife handle to engage only the forward pair or rear pair of sharpening members.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A knife sharpener comprising:

a base, an elongated slot extending from one end of said base, at least one pair of sharpening members, mounting means for mounting said at least one pair of sharpening members in an overlapping V-formation with said at least one pair of sharpening members crossing in front of said elongated slot, said mounting means including two pivot pins extending through said base, said at least one pair of sharpening members being fixedly mounted on said two pivot pins, said mounting means further including securing means for securing said pivot pins on said base and for imparting a bias force on said pivot pins to be overcome by movement of said at least one pair of sharpening members, said securing means including two ends of a spring encased in a wrapper to prevent springbreak contamination in the event of breakage of said spring.

2. A knife sharpener according to claim 1, wherein said wrapper is made of a heat shrinkable polyolefin.

3. A knife sharpener according to claim 1, wherein said two pivot pins extend through said base.

4. A knife sharpener comprising:

a base, at least one pair of sharpening members, and mounting means for pivotally mounting said at least one pair of sharpening members on said base in an overlapping V-formation, said mounting means including two pivot pins extending through said base, said at least one pair of sharpening members being mounted on said pivot pins on one side of said base, said mounting means further including securing means located on an opposite side of said base for securing said two pivot pins on said opposite side of said base and for tensioning said at least one pair of sharpening members against a bias force overcome by a blade edge contacting said at least one pair of sharpening members and moving said at least one pair of sharpening members, said securing means including a spring and means for setting said spring on each of said two pivot pins with said spring extending between said two pivot pins.

5. A knife sharpener according to claim 4, wherein said means for setting said spring includes pivot wheels mounted on said two pivot pins, with each pivot wheel including an annular groove, said spring being pulled into said groove upon movement of said at least one pair of sharpening members.

6. A knife sharpener according to claim 5, wherein said spring extends tangentially to each of said pivot wheels when in a position of rest.

7. A knife sharpener according to claim 5, wherein said spring includes two ends with one end being secured to a set screw extending radially through each of said pivot wheels.

8. A knife sharpener according to claim 7, wherein a sleeve member surrounds one end of said spring on each of said set screws.

9. A knife sharpener comprising:

a base, two sharpening members, and pivot means for pivotally mounting said two sharpening members on said base in an overlapping V-formation, said pivot means including a spring having two ends and means for encasing said two ends of said spring for securing said two ends of said spring to said pivot means to prevent springbreak contamination in the event of breakage of said spring.

10. A knife sharpener according to claim 9, wherein said means for encasing includes a heat shrunk wrapper.

11. A knife sharpener according to claim 9, wherein said pivot means includes pivot pins extending through said base.

12. A knife sharpener according to claim 9, wherein said two sharpening members are located on one side of said base and a portion of said pivot means is located on an opposite side of said base.

13. A knife sharpener according to claim 9, wherein said two sharpening members engage stop pins against a bias of said spring in a position of rest.

14. A knife sharpener according to claim 9, wherein said pivot means includes pivot wheels having an annular groove for receipt of said spring upon movement of said two sharpening members due to engagement of said two sharpening members by a knife blade.

15. A knife sharpener according to claim 14, wherein said pivot means includes a set screw extending radially through each said pivot wheel to engage a pivot pin about which each said pivot wheel is concentrically mounted.

16. A knife sharpener according to claim 15, wherein said pivot pin extends through said base.

* * * * *